US006055833A

United States Patent [19]

Ding-Chiang

[11] Patent Number: 6,055,833

[45] Date of Patent: May 2, 2000

[54] PLUG LOCK

[76] Inventor: Ma Ding-Chiang, No. 40 Lane, 121, Hai Huan St., Tainan, Taiwan

[21] Appl. No.: 09/005,013

[22] Filed: Jan. 9, 1998

[51] Int. Cl.[7] ..... E05B 67/24

[52] U.S. Cl. ..... 70/39; 70/233

[58] Field of Search ..... 70/38–39, 233, 70/369–371

[56] References Cited

U.S. PATENT DOCUMENTS

| | | | |
|---|---|---|---|
| 4,823,566 | 4/1989 | Patton | 70/39 X |
| 4,987,753 | 1/1991 | Kuo | 70/39 |
| 5,331,830 | 7/1994 | Su | 70/39 X |
| 5,410,895 | 5/1995 | Hsu et al. | 70/39 |
| 5,490,402 | 2/1996 | Shieh | 70/39 |
| 5,511,400 | 4/1996 | Ma | 70/39 X |
| 5,678,431 | 10/1997 | Yan | 70/39 |
| 5,694,796 | 12/1997 | Couillard et al. | 70/39 |
| 5,720,191 | 2/1998 | Tsung-Chuan et al. | 70/39 X |

*Primary Examiner*—Suzanne Dino Barrett
*Attorney, Agent, or Firm*—Rosenberg, Klein & Lee

[57] ABSTRACT

A plug lock assembly is provided. The assembly comprises a sleeve member to which a detent catch member, a cylinder member, and a latch member are coupled. The detent catch member engages a face wall portion of the sleeve member through cooperating cambered surfaces such that the detent catch member may be placed into and out of its locking position. The detent catch member has formed thereon an open cambered groove section which is engaged by a locating pin extending from the sleeve member for limiting the axial displacement of the detent catch member in at least one direction. This reinforces the lock assembly against compromise of its locking function.

1 Claim, 5 Drawing Sheets

PLUG LOCK

BACKGROUND OF THE INVENTION

1. Field of the Invention

The present invention relates to a plug lock, and more particularly to a bullet connection lock, employing a pair of opposing face cams to actuate the locking and unlocking actions.

2. Description of the Prior Art

A conventional plug lock is shown in FIG. 5. The assembly includes a sleeve A, a cylinder B, a detent catch C, a sliding cam-sleeve D, a stationary cam-sleeve E, and a latch F. The detent catch C consists of a rounded head C1 at one end, a rod catch C2 extending from the opposite end, a slot C3 formed on the end face of the rounded head C1, and a blind hole C4 bored into the center of the slot C3 for receiving a spring C5 therein. The sliding cam-sleeve D and the stationary cam sleeve E each define hollow inside portions D1 and E1. Each is formed with a flat axial end and an opposed axial end formed with an edge cam surface having arcuate rabbets D2 and E2 and sallies D3 and E3, respectively. When assembled, the parts are mounted within the sleeve A in such manner that the stationary cam-sleeve E and the cylinder B are fixed therein. During operation, angular displacement of components of the cylinder B causes the sliding cam-sleeve D to angularly displace relative to the stationary cam-sleeve E so that the face cam engagement of the sliding cam-sleeve D with the stationary cam-sleeve E advances angularly. This, in turn, causes the rod catch C2 of the detent catch C to displace axially and thereby lock or release the latch F.

Hence, by turning the sliding cam-sleeve D relative to the stationary cam-sleeve E, the axial advancement and withdrawal of the detent catch C is effected. But several shortcomings inhere in such prior art assemblies as follows:

1. The numerous required parts require correspondingly numerous mounting processes, and thereby increases production costs;
2. The detent catch is not directly retained in locking position so that the lock may be easily compromised.

SUMMARY OF THE INVENTION

It is therefore a primary object of the present invention to provide a plug lock assembly having less required parts than in prior art assemblies, in which the detent catch is retained in locking position to resist unauthorized unlocking.

These and other objects are achieved in a plug lock assembly formed in accordance with the present invention. The subject assembly comprises a sleeve member, a detent catch member, a cylinder member, and a latch member coupled together. The face cam engagement of opposing portions of the detent catch member and the sleeve member serve in part to obviate the above-mentioned sliding and stationary cam-sleeves D, E of the prior art, so as to reduce the number of parts. At another portion of the detent catch member, an open cambered groove section is formed peripherally about at least a portion thereof. This grooved section is engaged by a location pin protruding from the sleeve member. The detent catch member may thus be reinforced in its locking position in order to prevent the lock from forced unlocking. The cylinder member includes a locking bar extending axially from a front end thereof. The latch member is formed with an annular groove at an appropriate position adjacent its head, and the sleeve member is formed with an axial bore extending from an open end. At an opposed end of the sleeve member is formed a transversely extended bore that receives a setting spring. At the inner end of the axial bore, a face wall portion extends radially to define a face cam (cambered surface) and a center through-hole. The through-hole enables communication between the axial and transverse bores. The detent catch member is formed with a flat end and a face cam end having an arcuate contour corresponding to that of the cambered surface of the sleeve member. Accordingly, it is formed with rabbets and sallies. A locking latch extends from the center of the detent catch member for insert through the through-hole of the sleeve face wall portion. An open cambered groove section is peripherally formed about at least a portion of one end of the detent catch member, and a projection is formed to protrude axially therefrom. A slot is formed to cross-cut the projection.

When assembled, the detent catch member is placed in the sleeve member so that its rabbets and sallies engage the cambered surface of the face wall portion, and the cylinder is located in the sleeve member with a spring received upon the locking bar of the cylinder member that engages the slot of the detent catch member. Upon turning the cylinder, the detent catch member is turned, causing its rabbets and sallies to slide and advance angularly relative to the face wall portion of the cambered surface. This enables control of the detent catch member extending into and withdrawing from locking engagement with the latch member.

DETAILED DESCRIPTION OF THE PREFERRED EMBODIMENTS

Figure 1:
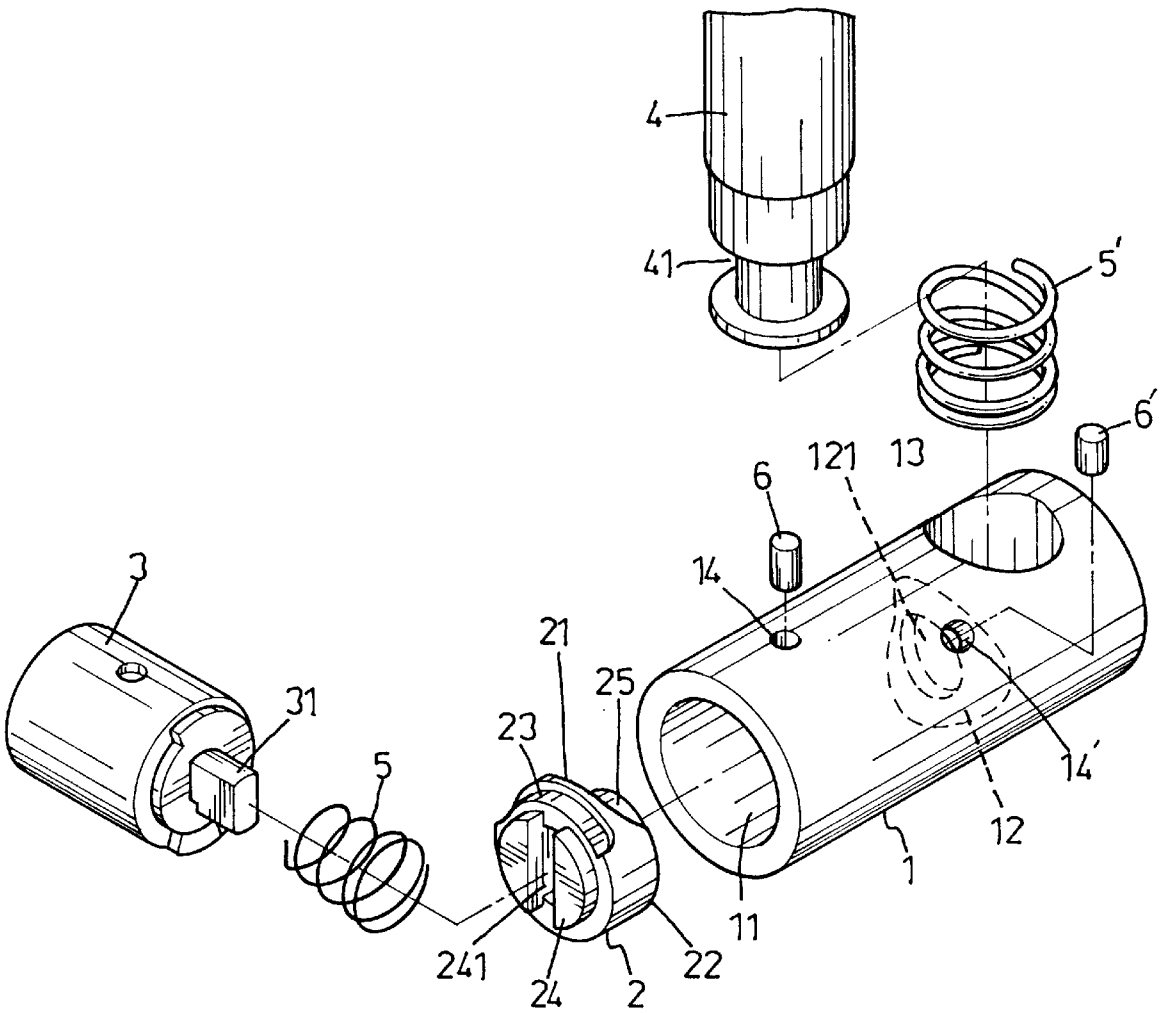
FIG. 1 is an exploded view of an embodiment of the present invention.

Referring to FIG. 1, the lock assembly of the present invention includes in one embodiment a sleeve, a detent catch 2, a cylinder 3, and a latch 4 biased by a spring 5'.

The sleeve 1 is formed as a hollow body having an axial bore 11 of predetermined depth. Sleeve 1 includes a face wall portion having a face cam (cambered surface) 12 formed thereon which extends into the bore 11. A center through-hole 121 is defined axially through the center of the cambered surface wall to communicate with a perpendicular locking hole 13 transversely bored through the side surface of the sleeve 1, and a pair of lock-pin holes 14 and 14' are formed through the side surface as shown.

The detent catch 2 includes a flat end and cambered surface end at opposite ends thereof. Arcuate rabbets 21 and sallies 22 are formed at the cambered surface end and are configured to cooperate with the cambered surface 12 of the sleeve 1. An open cambered groove section 23 is formed about the flat end along its rim, and a projection 24 is formed at the surface of the flat end. A slot 241 is formed to transaxially extend on, or cross-cut, the center of the projection 24. At the cambered surface end, a locking latch 25 is formed to extend axially outward to pass through the through-hole 121.

The cylinder 3 includes a locking bar 31 that extends from one end, and the latch 4 has an annular groove 41 formed adjacent one end.

Figure 2:
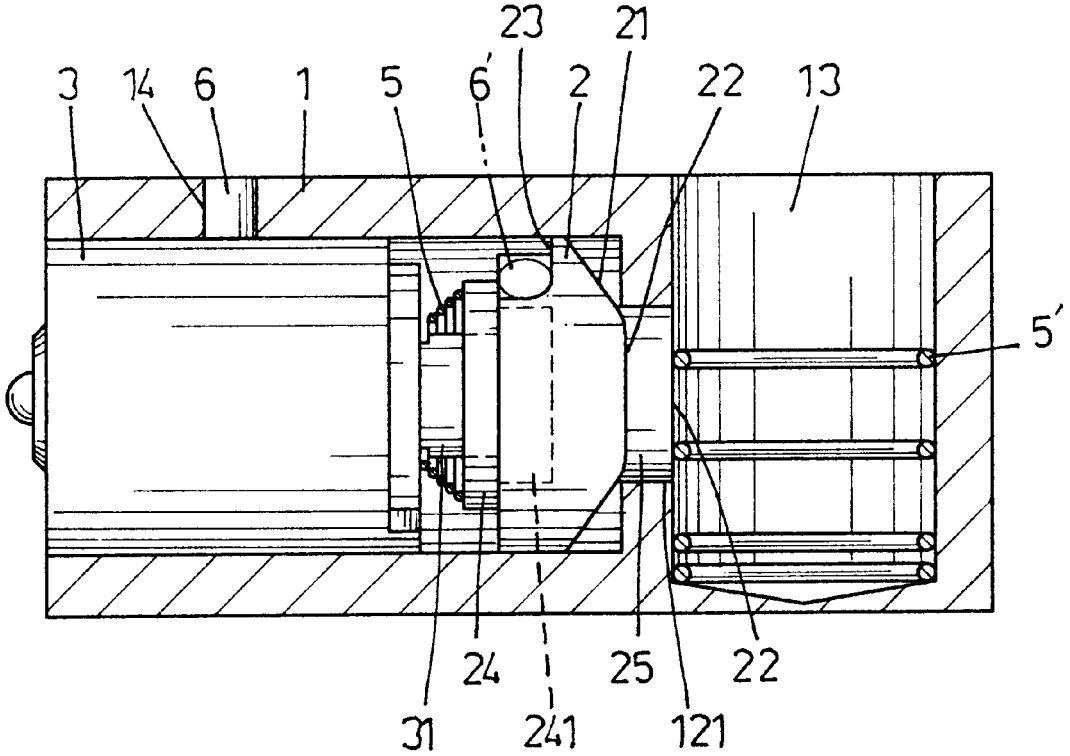
FIG. 2 is a sectional view of an embodiment of the present invention.

When assembled as shown in FIG. 2, a spring 5 is received on the locking bar 31 of the cylinder 3, and locating pins 6 and 6' are inserted into the lock-pin holes 14 and 14' to respectively secure the cylinder 3 in place and to limit the axial displacement of detent catch 2 by engaging the cambered groove section 23. The locking bar 31 of the cylinder 3 inserts into the slot 241 of the detent catch 2, while the rabbets 21 and sallies 22 of the detent catch 2 cambered surface end engage the cambered surface 12 of the sleeve 1, and the locking latch 25 inserts into the through-hole 121. A spring 5' is disposed in the locking hole 13.

Figure 3:
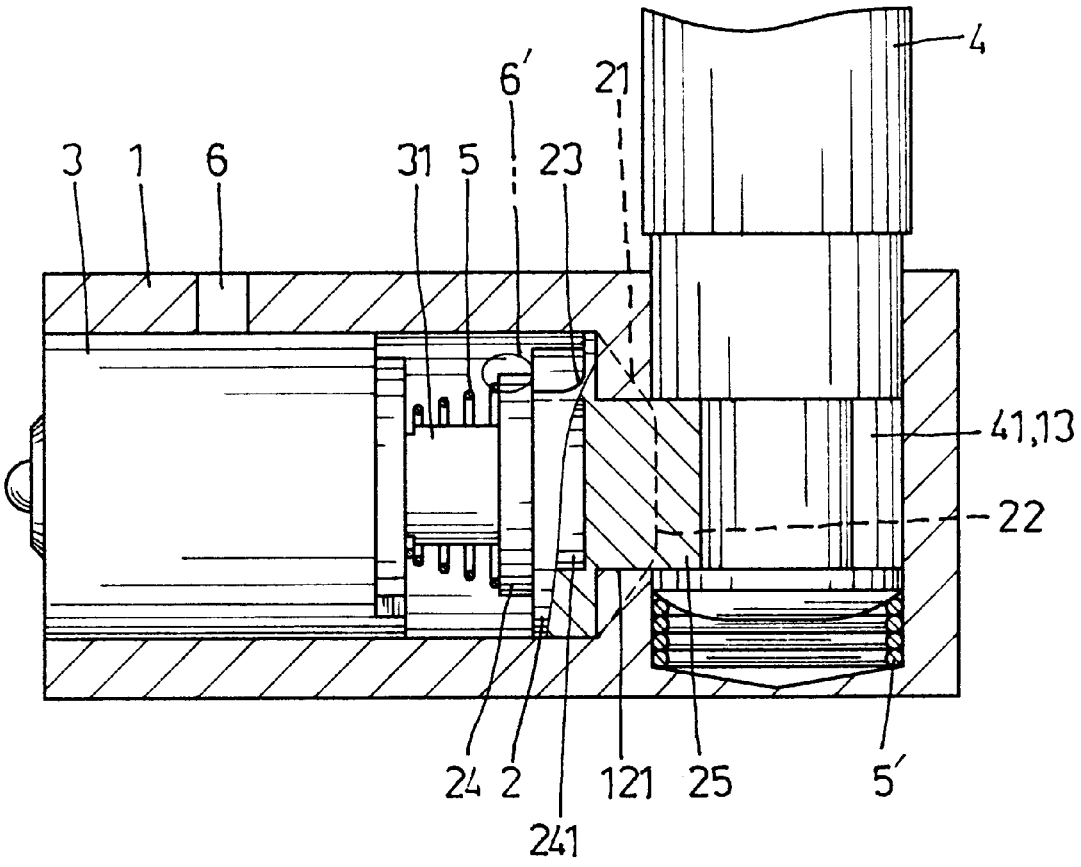
FIG. 3 is a sectional view of an embodiment of the present invention shown in a locked configuration.

When the assembly is in its locked configuration as shown in FIG. 3, the end of the locking latch 25 of the detent catch 2 is urged to extend into the locking hole 13, with the latch 4 advanced into the locking hole 13 and compressing the spring 5'. The biasing force of the spring 5 causes the locking latch 25 to extend into the locking hole 13 and engage the annular groove 41 of the latch 4. The latch 4 is thus locked in the locking hole 13, and the locating pin 6' catches the end of the cambered groove 23 to reinforce the detent catch 2 in its locking position. Even where striking forces are applied on the blind end of the sleeve 1, the detent catch 2 is reinforced against withdrawal from its locking position.

Figure 4:
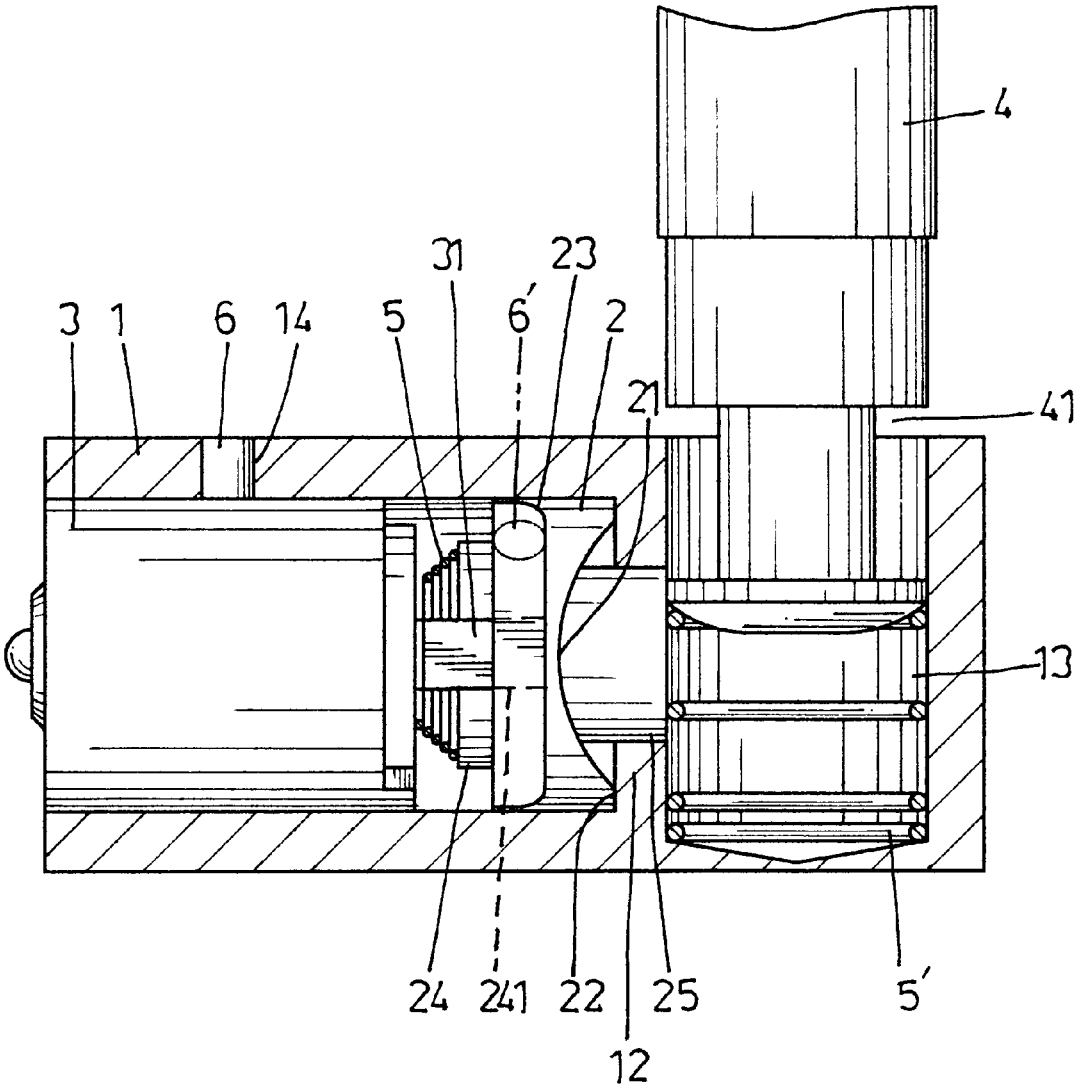
FIG. 4 is a sectional view of an embodiment of the present invention shown in an unlocked configuration; and, FIG. 5 is an exploded view of a prior art lock assembly.
Figure 5:
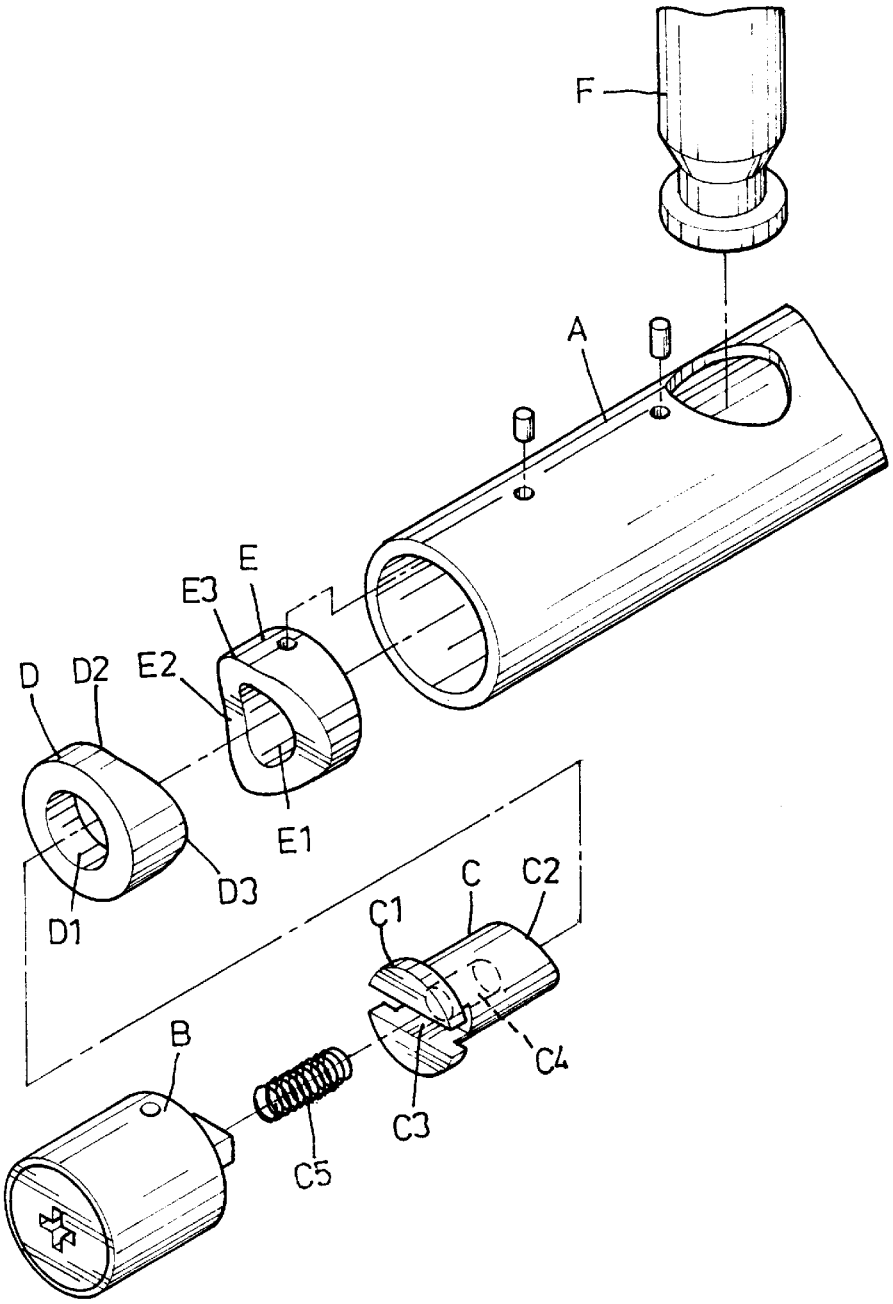
FIG. 5 (PRIOR ART)

To bring the assembly to its unlocked configuration shown in FIG. 4, the cylinder 3 is turned with the key, causing the locking bar 31 to angularly displace the detent catch 2. When the sallies 22 of the detent catch 2 advance angularly to engage the peaks of the cambered surface 12, the detent catch 2 displaces axially to compress the spring 5 (so that the locking bar 31 passes further into the slot 241), and the locking latch 25 is withdrawn from engagement with the annular grove 41 of the latch 4 to release it. The cambered groove section 23 of the detent catch 2 advances relative to the locating pin 6' to permit the withdrawal of the detent catch 2.

What is claimed is:

1. A lock assembly comprising:

(a) an elongate sleeve member having a first bore extending longitudinally therein and a second bore extending transversely relative to said first bore, said sleeve member having a face wall portion extending radially into said first bore, said face wall portion defining a cambered surface and having formed therein a through hole communicating with said first and second bores, said sleeve member having at least one pin portion protruding transversely into said first bore;

(b) a latch member displaceably received in said second bore of said sleeve member;

(c) a detent catch member coaxially received in said first bore of said elongate sleeve member, said detent catch member having axially opposed first and second ends, said first end defining a cambered surface engaging said cambered surface of said face wall portion in angularly displaceable manner, said detent catch member including a locking latch projecting axially from said first end for insert into said through hole of said face wall portion and a projection portion protruding from said second end, said projection portion having a substantially transaxial slot formed therein, said second end having a cambered groove section formed peripherally about at least a portion thereof, said cambered groove section being adapted to engage said pin portion of said sleeve member for limiting the axial displacement of said detent catch member in at least one direction;

(d) a cylinder member coaxially received in said first bore and coupled to said detent catch member in resiliently biased manner, said cylinder member having a locking bar portion projecting axially therefrom to engage said slot of said second end projection portion of said detent catch member;

whereby said detent catch member is angularly displaceable between at least first and second angular positions responsive to angular displacement of said cylinder member locking bar portion, said locking latch portion extending into said second bore of said sleeve member for locking engagement with said latch member when said detent catch member is disposed in one of said first and second angular positions.

* * * * *